US006814690B1

(12) United States Patent
Stearns

(10) Patent No.: US 6,814,690 B1
(45) Date of Patent: Nov. 9, 2004

(54) TORSO EXERCISE METHODS AND APPARATUS

(76) Inventor: Kenneth W. Stearns, P.O. Box 55912, Houston, TX (US) 77055

( * ) Notice: Subject to any disclaimer, the term of this patent is extended or adjusted under 35 U.S.C. 154(b) by 0 days.

(21) Appl. No.: 10/427,396

(22) Filed: May 1, 2003

(51) Int. Cl.[7] ..... A63B 22/04
(52) U.S. Cl. ..... 482/52; 482/122; 482/128
(58) Field of Search ..... 482/93, 95–97, 482/121–123, 128, 408, 52, 908

(56) References Cited

U.S. PATENT DOCUMENTS 4,645,197 A * 2/1987 McFee ..... 482/31
5,046,726 A * 9/1991 Van Straaten ..... 482/125
5,071,119 A * 12/1991 Johnson ..... 482/112
5,154,685 A * 10/1992 Chen ..... 482/126
5,695,436 A * 12/1997 Huang ..... 482/121
5,711,749 A * 1/1998 Miller ..... 482/135
5,913,756 A * 6/1999 Glaser ..... 482/128
6,113,522 A * 9/2000 Fontenot et al. ..... 482/111
6,626,808 B1 * 9/2003 Adams ..... 482/140

* cited by examiner

*Primary Examiner*—Nicholas D. Lucchesi
*Assistant Examiner*—Tam Nguyen

(57) ABSTRACT

An abdominal exercise device includes a frame, and upper and lower force receiving members movably mounted on the frame and constrained to move in opposite directions. A resistance device is interconnected between the frame and at least one of the force receiving members to resist movement of the members toward one another and/or to bias the members away from one another. The lower member is configured to support a person's feet, and the upper member is configured to support a person's hands and/or to engage a person's chest. The device facilitates a combination crunch and leg lift exercise that involves both a person's upper abdominal muscles and a person's lower abdominal muscles. Also, the upper member may be resiliently supported in a manner that facilitates exercise of a person's oblique muscles, as well.

11 Claims, 8 Drawing Sheets

TORSO EXERCISE METHODS AND APPARATUS

FIELD OF THE INVENTION

The present invention relates to exercise equipment, and in particular, to torso exercise methods and apparatus.

BACKGROUND OF THE INVENTION

Various exercise devices have been developed to exercise various muscles of the human body, including a person's torso muscles. Many prior art devices primarily work only a person's upper abdominal muscles or a person's lower abdominal muscles. Other prior art devices effectively work both, and some known devices work a person's oblique muscles, as well. Generally speaking, the combination devices are either relatively complicated or relatively ineffective. In another words, a need remains for a relatively simple, yet effective torso exercise device.

SUMMARY OF THE INVENTION

The present invention provides exercise apparatus and methods suitable for exercise of a person's torso muscles. A preferred embodiment of the present invention includes an upper body support movably mounted on a frame and biased toward an upward position, and a lower body support movably mounted on the frame and biased toward a downward position. Many of the features and advantages of the present invention will become apparent to those skilled in the art from the more detailed description that follows.

BRIEF DESCRIPTION OF THE FIGURE OF THE DRAWING

With reference to the Figures of the Drawing, wherein like numerals designate like parts and assemblies throughout the several views, FIG. 1 is a perspective view of a preferred embodiment exercise device constructed according to the principles of the present invention;

DETAILED DESCRIPTION OF A PREFERRED EMBODIMENT

Figure 1:
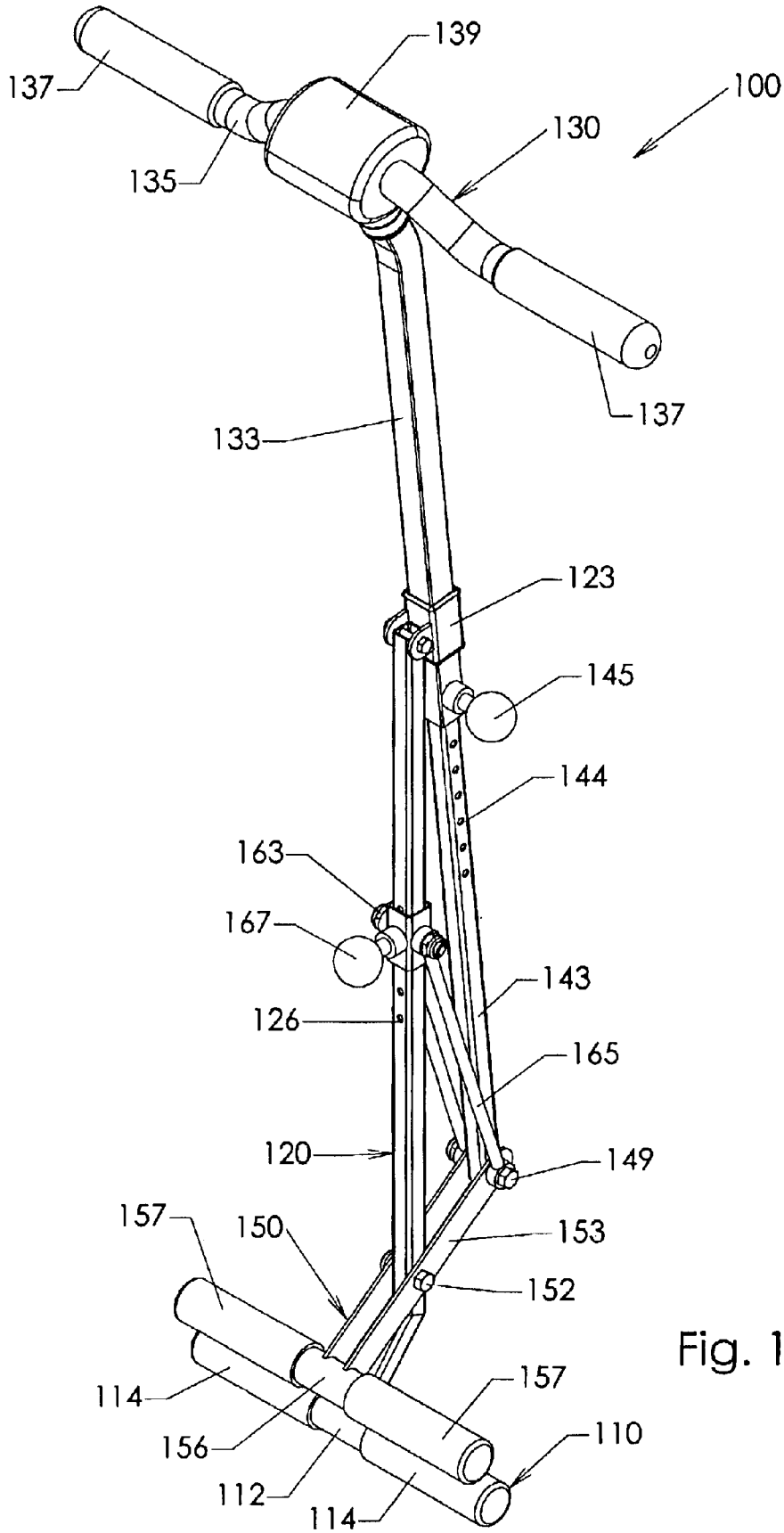
Figure 2:
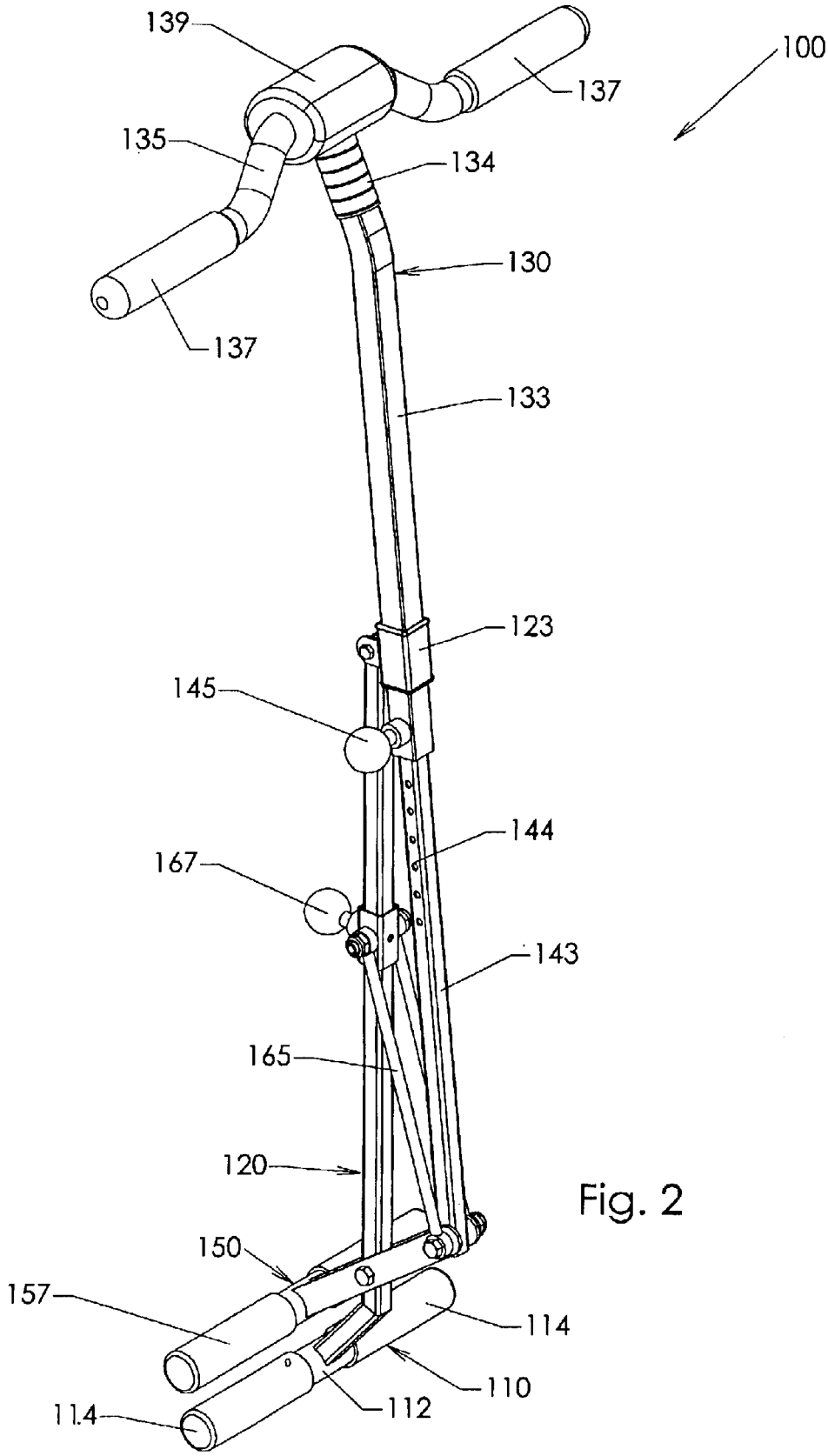
FIG. 2 is another perspective view of the exercise device of FIG. 1.
Figure 3:
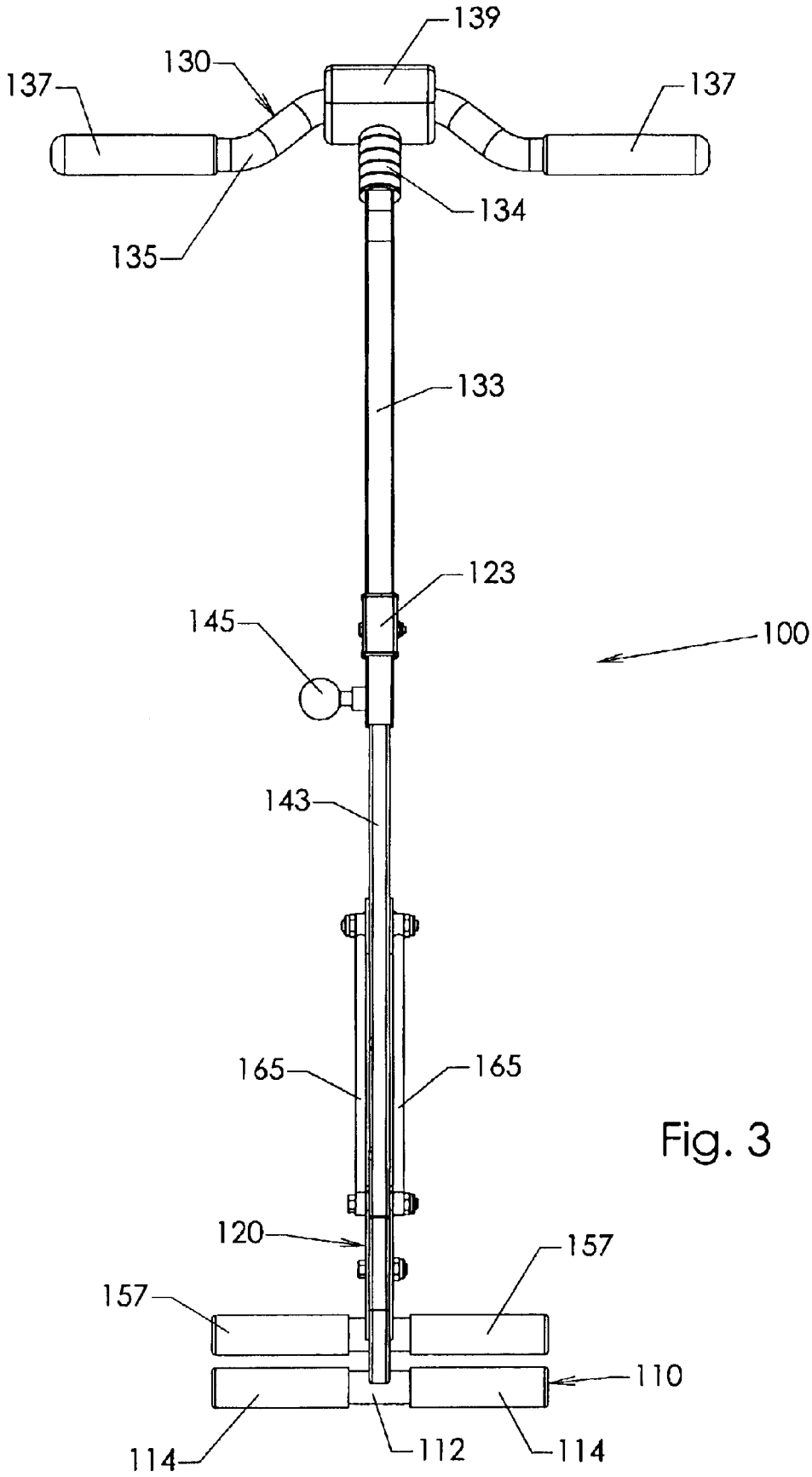
FIG. 3 is a front view of the exercise device of FIG. 1.
Figure 4:
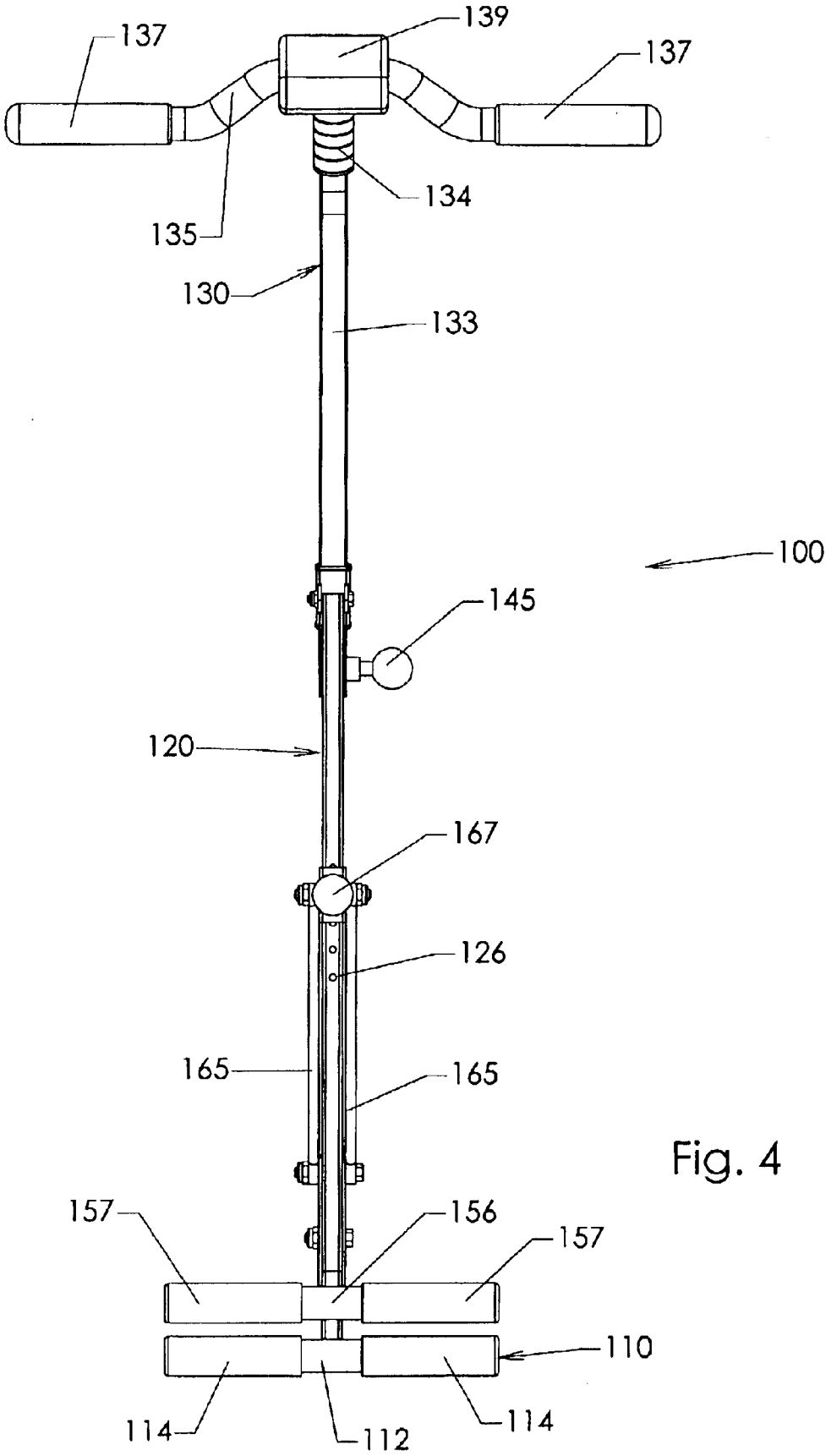
FIG. 4 is a rear view of the exercise device of FIG. 1.
Figure 5:
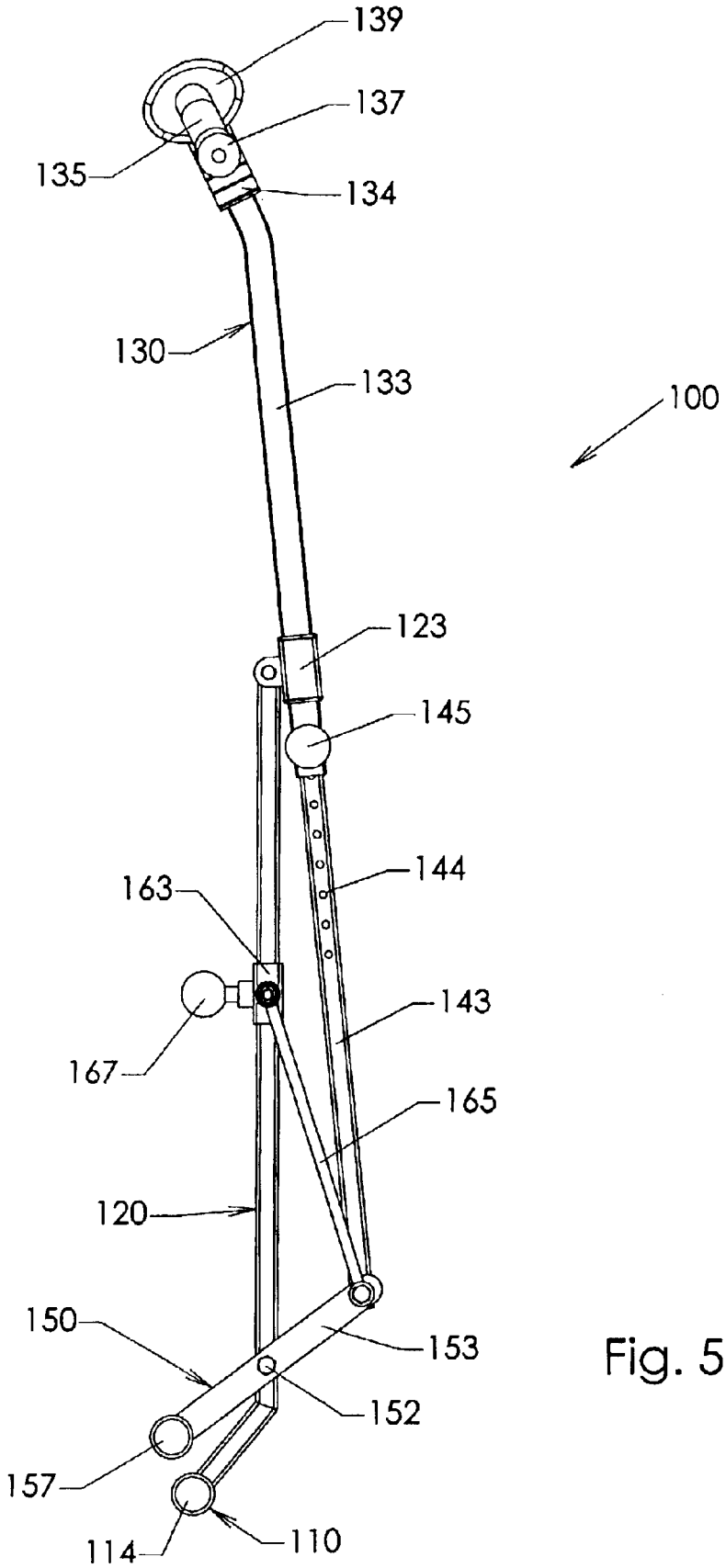
FIG. 5 is a side view of the exercise device of FIG. 1.
Figure 6:
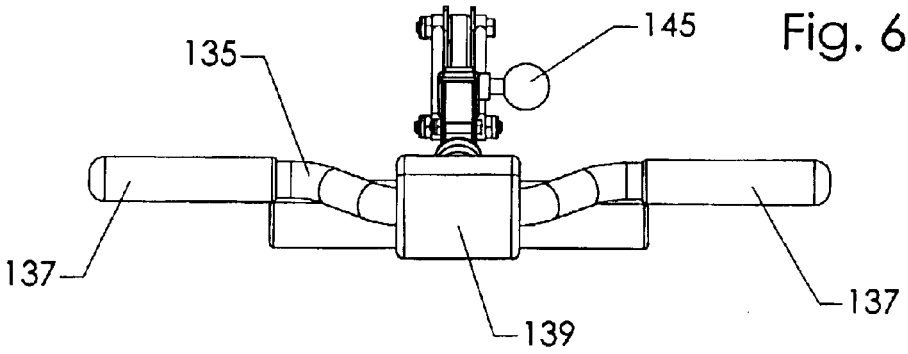
FIG. 6 is a top view of the exercise device of FIG. 1.
Figure 7:
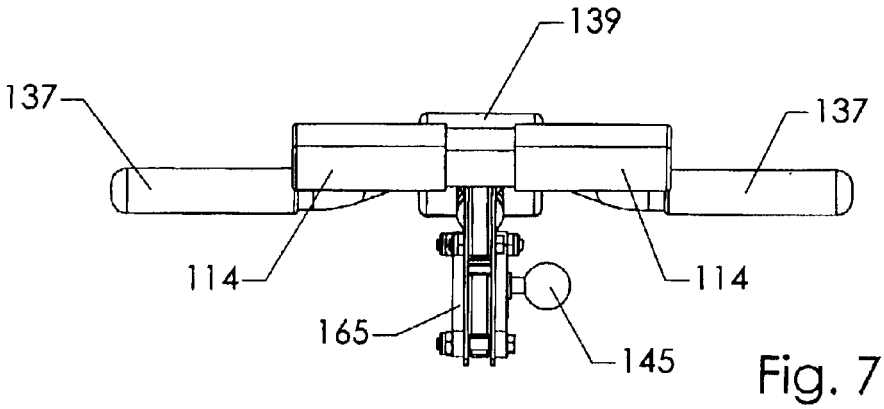
FIG. 7 is a bottom view of the exercise device of FIG. 1.

A preferred embodiment exercise device constructed according to the principles of the present invention is designated as 100 in FIGS. 1–9. The device 100 may be described generally in terms of a frame, an upper body support movably mounted on the frame, a lower body support movably mounted on the frame, and a means for biasing the upper body support toward an upper end of the frame, and/or for biasing the lower body support toward a lower end of the frame.

The frame may take various forms and/or be made in various manners. In the accompanying figures, the frame appears without any cover or shroud, but it is to be understood that various shrouds may be provided about the apparatus or portions thereof. The frame may be described in terms of a base 110 configured to bear against a floor surface, and a stanchion 120 having a lower end rigidly connected to the base 110. The base 110 includes a cylindrical profile tube 112 and opposite end caps 114 mounted on respective ends of the tube 112. The stanchion 120 is a square profile tube that is bent approximately forty degrees near its lower end. The stanchion 120 supports a pivot axis a short distance above the bend. A sleeve 123 is pivotally mounted on an opposite, upper end of the stanchion 120 to accommodate insertion of a longitudinally extending, upper bar segment 133.

The upper bar segment 133 is part of the upper body support or plunger 130. A resilient member 134 is mounted on an upper end of the upper bar segment 133, and a laterally extending handlebar 135 is mounted on top of the resilient member 134. The resilient member 134 accommodates twisting and/or rocking of the handlebar 135 relative to the upper bar segment 133. Opposite ends of the handlebar 135 extend in opposite directions away from the upper bar segment 133. Left and right hand grips 137 are mounted on respective ends of the handlebar 135, and a chest pad 139 is mounted on an intermediate portion of the handlebar 135 (above the resilient member 134). The hand grips 137 are preferably downwardly offset relative to the chest pad 139 to accommodate both placement of a person's chest against the chest pad 139 and placement of a person's hands between his chest and the hand grips 137.

A lower bar segment 143 is inserted in telescopic fashion into the lower end of the upper bar segment 133, and a fastener 145 is inserted through a hole in the upper bar segment 133 and into one of several holes 144 in the lower bar segment 143. The fastener 145 is a spring-loaded "pop pin" that is biased toward engagement with the holes 144 in a manner known in the art. However, other fasteners, including spring detent pins, may be used without departing from the scope of the present invention. In any event, the vertical array of holes 144 facilitates adjustment of the distance defined between the chest pad 139 and the base 110 when the device 100 is at rest.

An opposite, lower end of the lower bar segment 143 is pivotally connected to the forward ends of parallel bars 153, which are part of the lower body support or lever 150. In this regard, a bolt 149 or other suitable fastener is inserted through aligned holes in the bars 153 and the lower bar segment 143. The bars 153 have opposite, rearward ends that are rigidly secured to an intermediate portion of a foot rest 156. A bolt 152 or other suitable fastener extends through an intermediate portion of each bar 153 and through a hole in the stanchion 120 to pivotally mount the lower body support 150 on the stanchion 120 (at the pivot axis described above). The foot rest 156 is a circular profile tube having opposite distal ends that extend in opposite directions away from the bars 153, and respective left and right caps 157 mounted on the distal ends.

The foregoing interconnections between the stanchion 120, the upper body support 130, and the lower body support 150 constrain the upper body support 130 and the foot rest 156 to move in generally opposite directions relative to the stanchion 120 (when the stanchion 120 is stabilized). For example, when a person pushes down on the upper body support 130, the foot rest 156 is constrained to move upward. Though not shown on the embodiment 100, respective left and right toe cups, foot straps, or other "anchors" may be mounted on the distal ends of the foot rest 156 to overlie a person's feet and receive an upward pulling force exerted by a person's feet. Any resulting upward movement of the foot rest 156 will coincide with downward movement of the upper body support 130.

The force of gravity acting on a person's legs tends to resist movement of the handlebar 135 and the foot rest 156 toward one another, while the force of gravity acting on a person's chest, shoulders, and head tends to assist such movement. Although added resistance or assistance is not necessary to practice the subject invention, the embodiment 100 is shown with a resistance system that is configured and arranged to resist movement of the handlebar 135 and the foot rest 156 toward one another, and/or to bias the handlebar 135 upward and the foot rest 156 downward.

The resistance system includes first and second elastic members or bungee cords 165 interconnected between the stanchion 120 and the body supports 130 and 150. In this regard, each bungee cord 165 has a lower end that terminates in a collar, and the bolt 149 is inserted through these collars to secure the lower ends of the bungee cords 165 to the pivot joint defined between the lower bar segment 143 and the bars 153. Those skilled in the art will recognize that the bungee cords 165 could alternatively be connected to only one of the body supports 130 and 150 (since they are linked to one another). Each bungee cord 165 has an opposite, upper end that also terminates in a collar, and these collars are secured to opposite sides of a sleeve 163. For example, threaded shafts may project outward from opposite sides of the sleeve 163, and nuts may be threaded onto respective shafts to secure the collars in place.

The sleeve 163 is slidably mounted on the stanchion 120, and a fastener 167 extends through a hole in the sleeve 163 and into one of several holes 126 in the stanchion 120 to "pre-stretch" the bungee cords 165 a desired amount. The fastener 167 is preferably similar in construction and function to the fastener 145 used to adjust the upper body support 130. Indicia may be provided on the stanchion 120 (or a shroud disposed about the stanchion 120) to provide a relative indication of the resistance setting. As the sleeve 163 is moved upward, resistance to abdominal crunch exercises is increased.

The resistance system may be modified with various enhancements and/or replaced by alternative arrangements. For example, an intermediate bungee guide may be mounted on the stanchion 120 to engage an intermediate portion of the bungee cords 165. Moreover, such a guide or guides may be movably mounted on the stanchion 120 and adjusted to change how much force is required to move the supports 130 and 150 through their respective ranges of motion. One way to implement such an arrangement is to extend the sleeve 163 downward, mount the guide(s) on a lower distal end of the sleeve 163, and route the bungee cords 165 about the guide(s).

The present invention facilitates exercise of a person's upper abdominal muscles (by user force exerted downward against the hand grips 137 and/or the chest pad 139), and exercise of a person's lower abdominal muscles (by user force exerted upward to lift the user's legs). Moreover, the present invention facilitates exercise of a person's oblique muscles (by user exerted force that rocks and/or twists the hand grips 137 relative to the bar 133).

Figure 8:
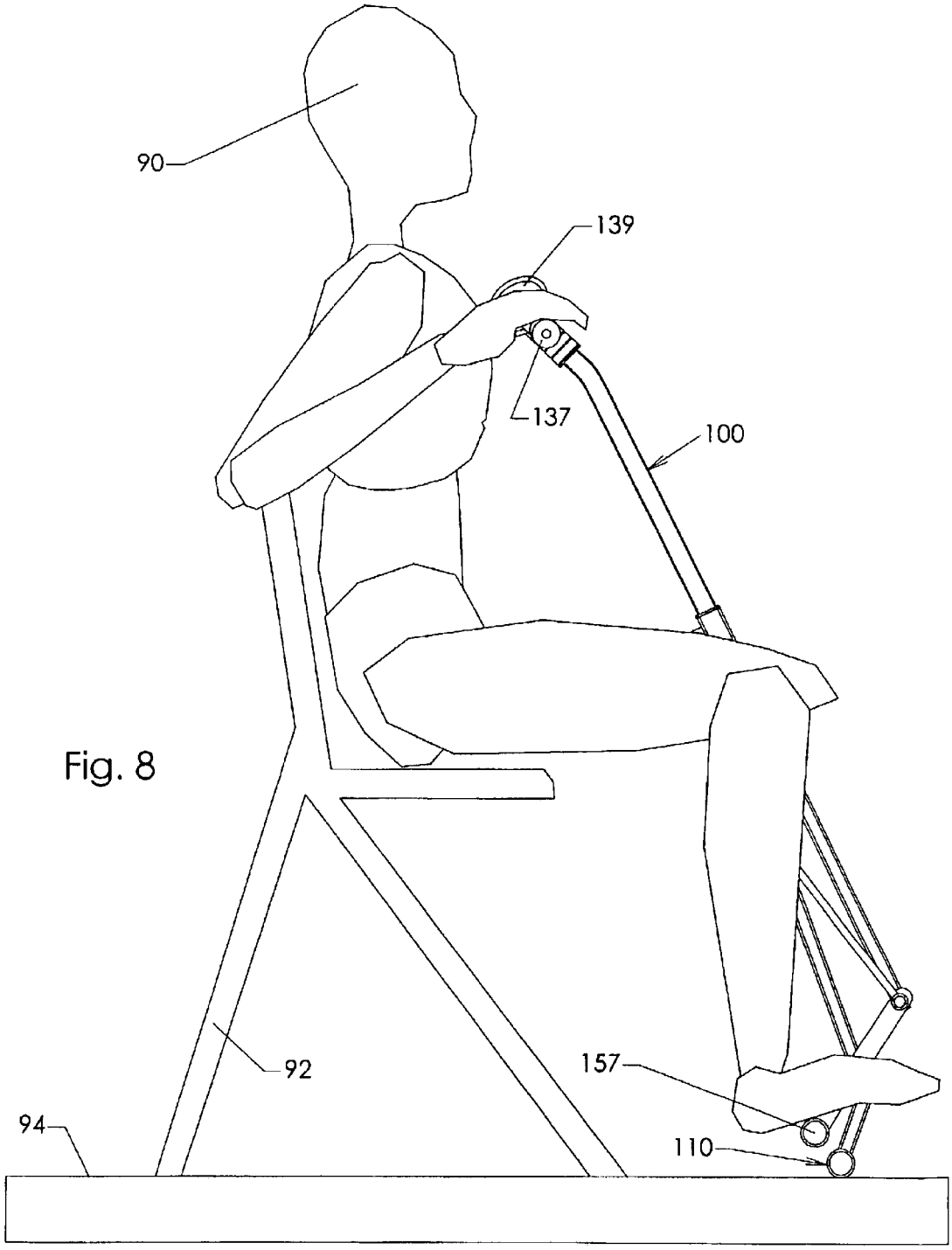
FIG. 8 is a side view of the exercise device of FIG. 1 bearing against a floor surface and held in a first operative position by a person sitting on a chair.
Figure 9:
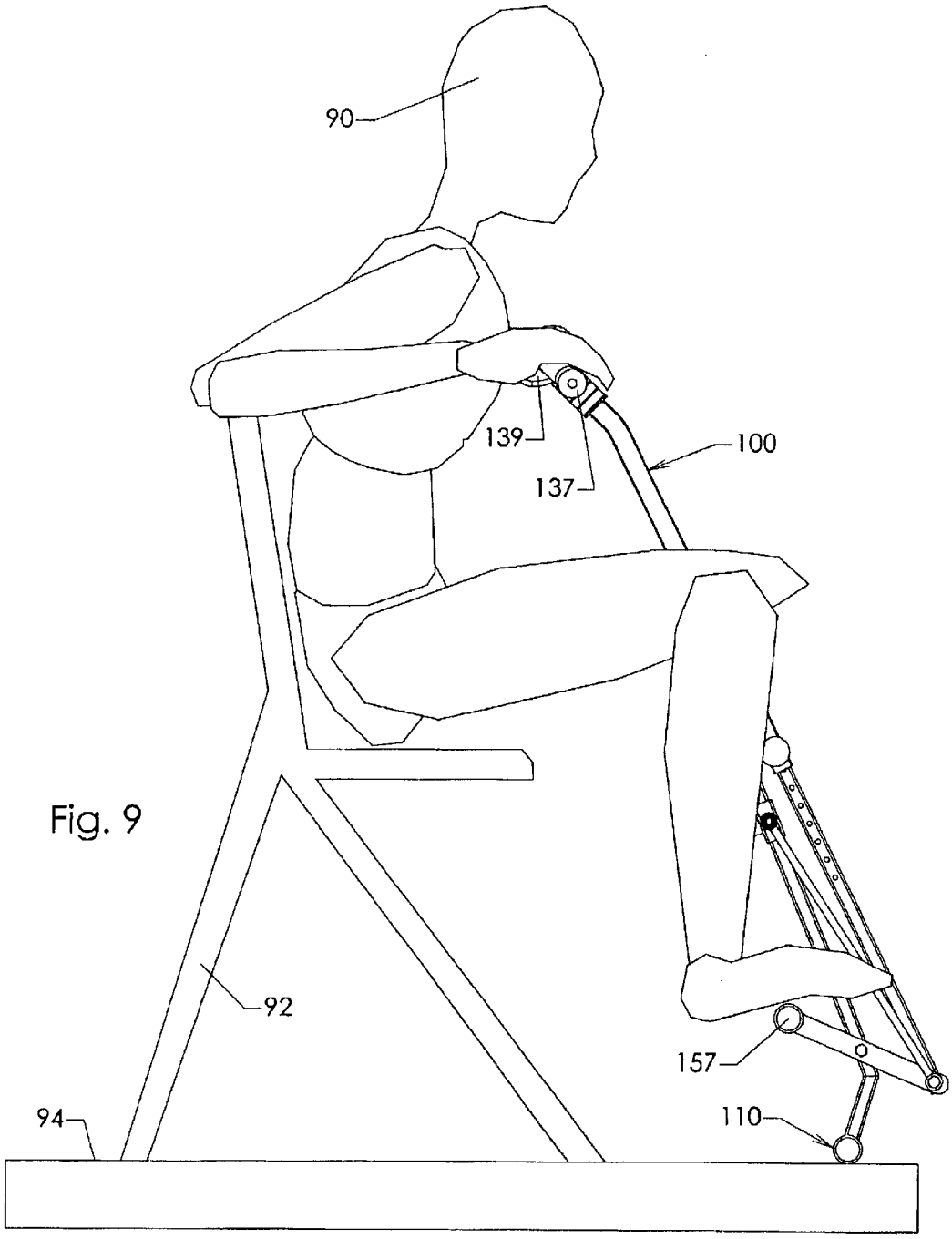
FIG. 9 is a side view of the exercise device of FIG. 8 bearing against the floor surface and moved to a second operative position by the person sitting on the chair.

As shown in FIGS. 8–9, a person 90 may use the device 100 by sitting on a chair 92 with the device 100 between her knees, and stabilizing the device 100 relative to the chair 92 and/or the ground 94 beneath the chair 92. In the case of the preferred embodiment 100, the base 110 of the device 100 is placed on the ground 94 in front of the chair. An alternative embodiment may be configured for mounting on or against the chair as an alternative to the floor. In either case, the person 90 places her feet on respective sides of the foot rest 156, and grasps the hand grips 137 in her respective hands and/or presses her chest against the chest pad 139. The person then presses down with her hands and/or her chest, and/or lifts up with her feet, subject to resistance provided by the bungee cords 165 (as well as gravity acting on the person's legs). As noted above, the person may adjust the resistance by repositioning the sleeve 163 along the stanchion 120. The person may also twist and/or rock the handlebar 135 to exercise her oblique muscles.

The present invention has been described with reference to specific embodiments and particular applications. However, this disclosure will also enable persons skilled in the art to recognize additional embodiments and/or applications which similarly incorporate the essence of the present invention. With the foregoing in mind, the scope of the present invention is to be limited only to the extent of the following claims.

What is claimed is:

1. A method of exercise, comprising the steps of:

providing an abdominal exercise device with (a) a frame having an upper end and a lower end, wherein the lower end is configured to bear against a floor surface; (b) an upper body support movably mounted on the frame proximate the upper end; and (c) a foot rest movably mounted on the frame proximate the lower end, and linked to the upper body support in a manner that constrains the foot rest and the upper body support to move in opposite directions; and encouraging a person to (a) sit on a conventional chair; (b) move the abdominal exercise device relative to the chair and into an operational position in front of the chair with the lower end of the frame on the floor surface; (c) place her feet on the foot rest; (d) hold the upper body support proximate her chest; and (e) perform an abdominal crunch exercise, wherein her cheat moves downward together with the upper body support, and her legs move upward together with the foot rest.

2. The method of claim 1, wherein the abdominal exercise device is provided with a resistance device interconnected between the frame and at least one of the upper body support and the foot rest, and the person is encouraged to adjust the resistance device prior to performing the abdominal crunch exercise.

3. The method of claim 1, wherein the upper body support is provided with a resilient intermediate section, and the person is encouraged to twist her torso while performing the abdominal crunch exercise.

4. The method of claim 3, wherein the upper body support is provided with opposite left and right handles projecting outward from respective sides of the intermediate section, and the person is encouraged to hold the handles proximate her chest during performance of the abdominal crunch exercise.

5. A method of exercise, comprising the steps of:

providing an abdominal exercise device with (a) a frame having an upper end and a lower end, wherein the lower end is configured to beat against a floor surface; (b) an upper body support movably mounted on the frame proximate the upper end; and (c) a foot rest movably mounted on the frame proximate the lower end, and linked to the upper body support in a manner that constrains the foot rest and the upper body support to move in opposite directions; and encouraging a person to (a) sit on a chair that is separate from the abdominal exercise device; (b) arrange the abdominal exercise device relative to the chair so that the lower end of the frame rests on the floor surface; (c) place her feet on the foot rest; (d) hold the upper body support proximate her chest; and (e) perform an abdominal crunch exercise, wherein her chest moves downward together with the upper body support, and her legs move upward together with the foot rest.

6. The method of claim 5, further comprising the step of accommodating changes in position of the abdominal exercise device relative to the chair during performance of the abdominal crunch exercise.

7. The method of claim 5, wherein arrangement of the abdominal exercise device relative to the chair involves lifting the abdominal exercise device off the floor surface.

8. A method of exercise, comprising the steps of:

providing an abdominal exercise device with (a) a frame having an upper end and a lower end, wherein the lower end is configured to bear against a floor surface; (b) an upper body support movably mounted on the frame proximate the upper end; and (c) a foot rest movably mounted on the frame proximate the lower end, and linked to the upper body support in a manner that constrains the foot rest and the upper body support to move in opposite directions;

encouraging a person to (a) sit on a chair; (b) move the abdominal exercise device into an operational position in front of the chair with the lower end of the frame on the floor surface; (c) place her feet on the foot rest; (d) hold the upper body support proximate her chest; (e) perform an abdominal crunch exercise, wherein her chest moves downward together with the upper body support, and her legs move upward together with the foot rest; and accommodating changes in the operational position of the abdominal exercise device relative to the chair during performance of the abdominal crunch exercise.

9. The method of claim 8, wherein the accommodating step involves rotational movement of the abdominal exercise device relative to the floor surface.

10. The method of claim 8, wherein the abdominal exercise device is provided with the lower end configured to accommodate rotational movement of the abdominal exercise device relative to the floor surface during performance of the abdominal crunch exercise.

11. A method of exercise, comprising the steps of:

providing an abdominal exercise device with (a) a frame having an upper end and a lower end, wherein the lower end is configured to bear against a floor surface; (b) an upper body support movably mounted on the frame proximate the upper end, wherein the upper body support includes a resilient intermediate section, and left and right handles that project outward from respective sides of the intermediate section; and (c) a foot rest movably mounted on the frame proximate the lower end, and linked to the upper body support in a manner that constrains the foot rest and the upper body support to move in opposite directions; and encouraging a person to (a) sit on a chair; (b) arrange the abdominal exercise device relative to the chair so that the lower end of the frame rests on the floor surface; (c) place her feet on the foot rest; (d) hold the upper body support proximate her chest with her hands on the handles; (e) perform an abdominal crunch exercise, wherein her chest moves downward together with the upper body support, and her legs move upward together with the foot rest; and (f) twist the upper body support in a manner that exercises her oblique muscles during performance of the abdominal crunch exercise.

* * * * *